US008187043B2

(12) United States Patent
Kumakura et al.

(10) Patent No.: US 8,187,043 B2
(45) Date of Patent: May 29, 2012

(54) CRIMP TERMINAL AND METHOD OF PRODUCING CRIMP TERMINAL

(75) Inventors: Hideto Kumakura, Makinohara (JP); Naoki Ito, Makinohara (JP)

(73) Assignee: Yazaki Corporation, Tokyo (JP)

( * ) Notice: Subject to any disclaimer, the term of this patent is extended or adjusted under 35 U.S.C. 154(b) by 220 days.

(21) Appl. No.: 12/560,819

(22) Filed: Sep. 16, 2009

(65) Prior Publication Data

US 2010/0105257 A1 Apr. 29, 2010

(30) Foreign Application Priority Data

Oct. 24, 2008 (JP) ..... 2008-274635

(51) Int. Cl.
*H01R 4/10* (2006.01)

(52) U.S. Cl. ..... 439/882; 29/861

(58) Field of Classification Search ..... 439/877, 439/421, 882; 174/99 R; 29/861
See application file for complete search history.

(56) References Cited

U.S. PATENT DOCUMENTS 3,510,829 A * 5/1970 Keller ..... 439/421
3,812,448 A * 5/1974 Haitmanek ..... 439/421
2003/0013353 A1 1/2003 Sakaguchi et al.

FOREIGN PATENT DOCUMENTS

JP 2003-031274 A 1/2003

* cited by examiner

*Primary Examiner* — Vanessa Girardi
(74) *Attorney, Agent, or Firm* — Sughrue Mion, PLLC

(57) ABSTRACT

A crimp terminal includes a bottom plate portion for mounting a wire conductor of a wire thereon, a pair of press-fastening portions extended respectively from opposite side edges of the bottom plate portion to press-fasten the wire conductor, a raised portion provided on the bottom plate portion, and that has slanting surfaces slanting along an axis of the wire conductor mounted on the bottom plate portion to form a curved shape projecting toward the wire conductor, and an auxiliary contact portion protrudingly formed on at least one of the slanting surfaces. The auxiliary contact portion is moved in a direction along the axis of the wire conductor by a pressing load applied for crimping the wire conductor so that the wire conductor is elongated.

7 Claims, 5 Drawing Sheets

CRIMP TERMINAL AND METHOD OF PRODUCING CRIMP TERMINAL

BACKGROUND

This invention relates to a crimp terminal for an aluminum wire and a method of producing the crimp terminal, and more particularly to an improved technique of increasing an area of adhesion of the crimp terminal to the aluminum wire.

A conventional crimp terminal is formed by pressing a single metal sheet into a predetermined shape, and therefore has an integral or one-piece construction, and includes a conductor press-fastening portion 500 formed at a rear end portion of a terminal body portion thereof. As shown in FIG. 7, the conductor press-fastening portion 500 is adapted to be crimpingly connected to that portion of a wire conductor 505 of a sheathed wire 501 exposed by removing an insulative sheath 503 from the sheathed wire 501. The conductor press-fastening portion 500 includes a bottom plate portion 507 for the placing of the wire conductor 505 thereon, and a pair of press-fastening claws 509 extending respectively from opposite side edges of the bottom plate portion 507 so as to be press-fastened (or crimped) onto the wire conductor 505 placed on the bottom plate portion 507.

In order to enhance both an electrical connection and a mechanical connection between the wire conductor 505 and the bottom plate portion 507 of the crimp terminal, it is known that a plurality of conductor retaining grooves (hereinafter referred to as "serrations") 511 of a generally channel-shaped cross-section are formed in an inner surface 507*a* of the bottom plate portion 507 for contact with the wire conductor 505, and extend in a direction intersecting (usually, perpendicular to) an axis G of the wire conductor 505. In the case of crimping the crimp terminal to a copper wire, groove edges 511*a* of the serrations 511 are pressed hard against the surface of the wire conductor 505 to suitably bite thereinto upon press-fastening of the press-fastening claws 509, and by doing so, both the mechanical connection performance and the electrical connection performance can be enhanced, thus ensuring the reliability of the connection by press-fastening.

[Patent Literature 1] JP-A-2003-31274

In recent years, aluminum wires each comprising a wire conductor 505 made of aluminum have been extensively used for the purpose of achieving a lightweight design of the wire. Particularly when such aluminum wires are used in a wire harness for installation on a vehicle, the aluminum wires are effective in improving fuel consumption and an acceleration performance since the overall weight of the wire harness can be reduced.

However, in the case of crimping the crimp terminal to the aluminum wire, it is necessary to effect hard crimping in order to stabilize the electrical performance, and it has been difficult to balance the electrical performance with the mechanical performance. In order that when the edges 511*a* of the serrations 511 bite into the wire conductor 505, an oxide film formed by oxidation on the surface of the wire conductor 505 can be removed by the edges 511*a*, it is necessary to set the amount of biting to a relative large value. In order to increase the biting amount, it is necessary to increase a depth d of the serrations 511. On the other hand, in the case were the biting amount is set to such a large value, stresses concentrate on the press-fastened portion of the wire conductor 505 when an external pulling force acts on the wire conductor 505. Therefore, particularly in the case of the aluminum wire, the wire conductor 505 is liable to be cut or severed, and consequently the mechanical connection performance is lowered. And besides, it is difficult to secure the strength of the terminal which can withstand hard crimping.

SUMMARY

This invention has been made in view of the above circumstances, and an object of the invention is to provide a crimp terminal for an aluminum wire and a method of producing the crimp terminal, in which both an electrical connection performance and a mechanical connection performance can be enhanced.

In order to achieve the above object, according to the present invention, there is provided a crimp terminal, comprising:

a bottom plate portion for mounting a wire conductor of a wire thereon;

a pair of press-fastening portions extended respectively from opposite side edges of the bottom plate portion to press-fasten the wire conductor;

a raised portion provided on the bottom plate portion, and that has slanting surfaces slanting along an axis of the wire conductor mounted on the bottom plate portion to form a curved shape projecting toward the wire conductor; and an auxiliary contact portion protrudingly formed on at least one of the slanting surfaces, wherein the auxiliary contact portion is moved in a direction along the axis of the wire conductor by a pressing load applied for crimping the wire conductor so that the wire conductor is elongated.

In this aluminum wire crimp terminal, the area of adhesion to the wire conductor is increased by an amount corresponding to the area of the auxiliary contact portion. If the raised portion is formed merely into a curved-shape (that is, does not have any auxiliary portion), the raised portion obliquely receives the pressing force except at its apex portion when the aluminum wire is pressed against the raised portion upon press-fastening of the press-fastening portions, since the aluminum wire extends in the axial direction. In this case, the adhesion will not occur sufficiently. In the invention, the auxiliary contact portion is formed on the slanting surface, and with this construction the auxiliary contact portion adheres to the aluminum wire, so that the increased adhesion area is secured.

Preferably, the auxiliary contact portion and other auxiliary contact portions are formed on both of the slanting surfaces respectively, the slanting surfaces slanting in opposite directions from an apex portion of the curved raised portion.

In this crimp terminal, the adhesion area is doubled as compared with the case where the auxiliary contact portion is formed only on one of the slanting surfaces. And besides, the adhesion areas disposed respectively at the opposite sides of the apex portion are equal to each other, and the aluminum wire, when pressed against the raised portion, is elongated uniformly in the opposite directions from the apex portion, so that a stable adhesion performance can be obtained.

Preferably, the auxiliary contact portion and other auxiliary contact portions are formed on the slanting surfaces so as to be arranged in a slanting direction of the slanting surfaces.

In this crimp terminal, the auxiliary contact portions are arranged in downward sequence from the apex portion. During the time when the raised portion is generally flattened upon application of a pressing force to the apex portion, the auxiliary contact portions are brought sequentially into contact with the aluminum wire from the upper side, and therefore the adhesion area is gradually increased.

Preferably, the auxiliary contact portion is a stair-like portion having a flat surface substantially parallel to the bottom plate portion.

In this crimp terminal, the flat surfaces resembling steps of stairs are formed respectively on the auxiliary contact portions. Thus, an increased number of flat surfaces having good adhesion properties are provided. When the crimping is effected, the wire conductor is compressed to be elongated in the axial direction. At this time, the adhesion of the wire conductor to the flat surfaces of the stair-like portion is promoted by upward and downward loads due to the crimping and the right and left movements due to the elongation. Namely, the wire conductor elongated by the crimping is liable to adhere to the flat surfaces of the stair-like portion. With this adhesion, the electrical connection performance becomes stable.

Preferably, the raised portion is arranged between a pair of slits formed in the bottom plate portion, the pair of slits extending along the axis of the wire conductor. The raised portion is integrally formed on the bottom plate portion.

In this crimp terminal, the portion lying between the pair of slits is, for example, stamped out, and the stamped-out portion is raised to be partially separated from the bottom plate portion, and the flat slanting surfaces can be formed.

According to the invention, there is also provided a method of producing a crimp terminal including a bottom plate portion for mounting a wire conductor of a wire thereon, a pair of press-fastening portions extended respectively from opposite side edges of the bottom plate portion to press-fasten the wire conductor, a raised portion provided on the bottom plate portion, and that has slanting surfaces slanting along an axis of the wire conductor mounted on the bottom plate portion to form a curved shape projecting toward the wire conductor, and an auxiliary contact portion protrudingly formed on the slanting surface, the method comprising:

stamping a part of the bottom plate portion into a curved shape to form the raised portion; and pressing a die of a stair-like shape against the raised portion to form the auxiliary contact portion.

In this crimp terminal-producing method, first, the raised portion of the generally mountain-shape is formed by stamping with a large pressing force, and thereafter the auxiliary contact portion is formed on the slanting surface with a smaller pressing force, and by doing so, the deformation of the initially-formed mountain shape is kept to a minimum.

Preferably, the raised portion and the auxiliary contact portion are formed simultaneously by a curved-shape stair-like die.

In this crimp terminal-producing method, the raised portion having the auxiliary contact portion formed on the slanting surface can be formed by one pressing step, and the productivity of the aluminum wire crimp terminals can be enhanced.

In the crimp terminal of the present invention, the curved-shape raised portion is formed at the bottom plate portion, and the auxiliary contact portion is formed in a projecting manner on the slanting surface of this raised portion, and the auxiliary contact portion is moved or displaced in the direction along the axis by the pressing load applied for crimping the wire conductor, thereby elongating the wire conductor. Therefore, as compared with the case where the raised portion is formed merely into a curved-shape having only one apex portion (that is, does not have any auxiliary portion), the increased area of adhesion to the wire conductor is obtained, and thus the adhesion area can be increased while obtaining a high elastic reaction force by the raised portion. As a result, both the electrical connection performance and the mechanical connection performance can be enhanced.

In the crimp terminal-producing method of the invention, part of the bottom plate portion is stamped out into the curved-shape to form the raised portion, and the die having the stair-like shape is pressed against this raised portion to form the auxiliary contact portion. Therefore, after the relevant portion of the bottom plate portion is stamped out with a large pressing force to form the raised portion, the auxiliary contact portion can be formed in a projecting manner on the slanting surface of this raised portion with a smaller pressing force without deforming the curved-shape of the raised portion.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A preferred embodiment of an aluminum wire crimp terminal of the present invention and a method of producing this crimp terminal will be described with reference to the drawings.

Figure 1:
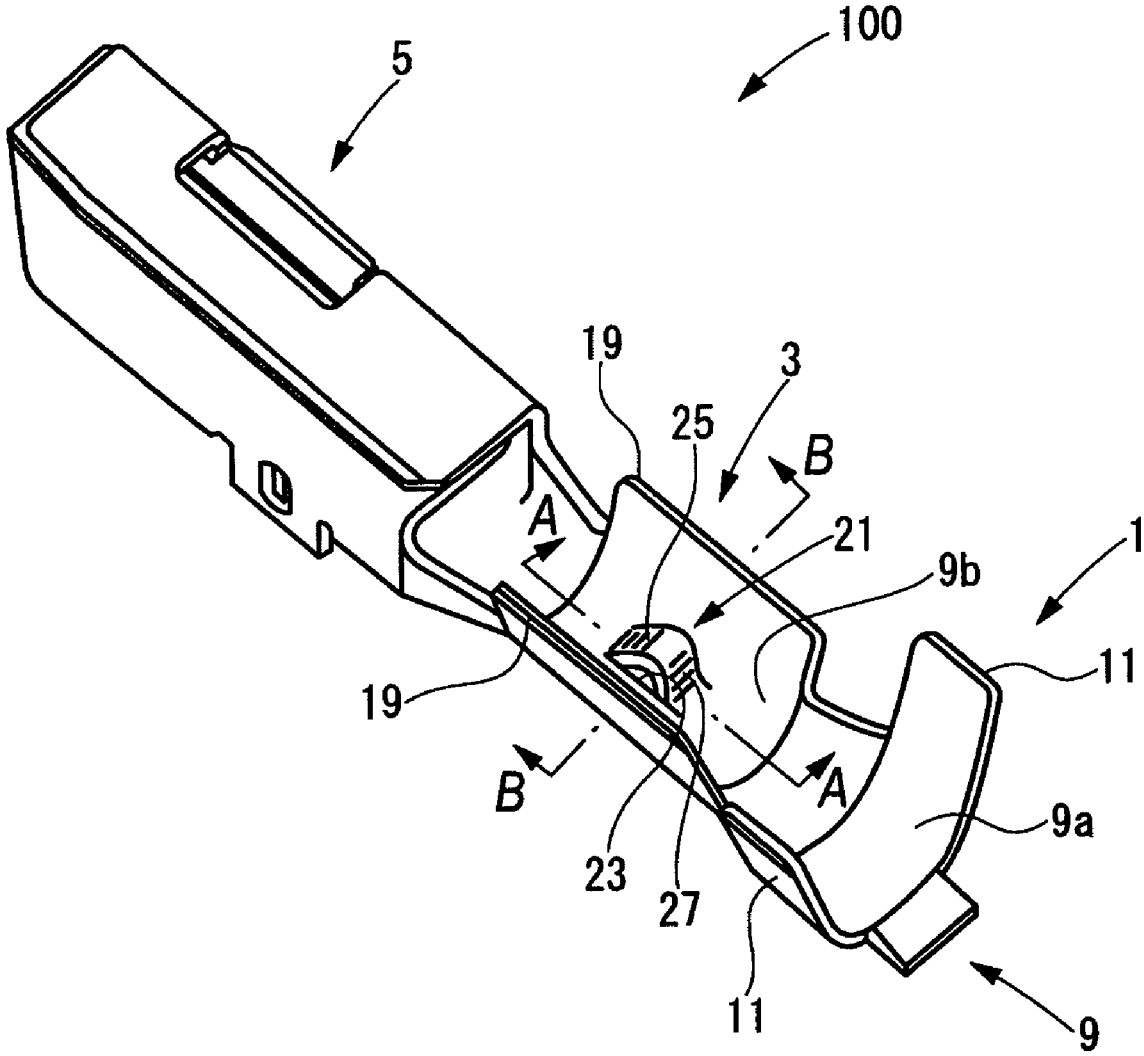
FIG. 1 is a perspective view of an aluminum wire crimp terminal of the present invention.
Figure 2:
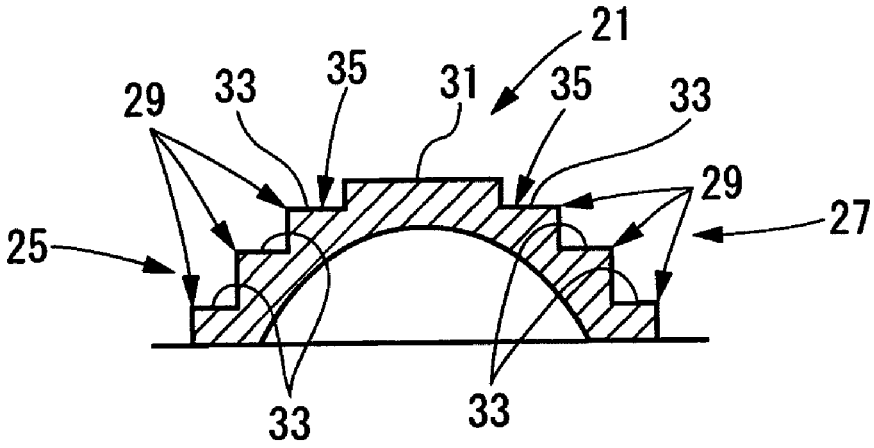
FIG. 2 is a cross-sectional view taken along the line A-A of FIG. 1.
Figure 3:
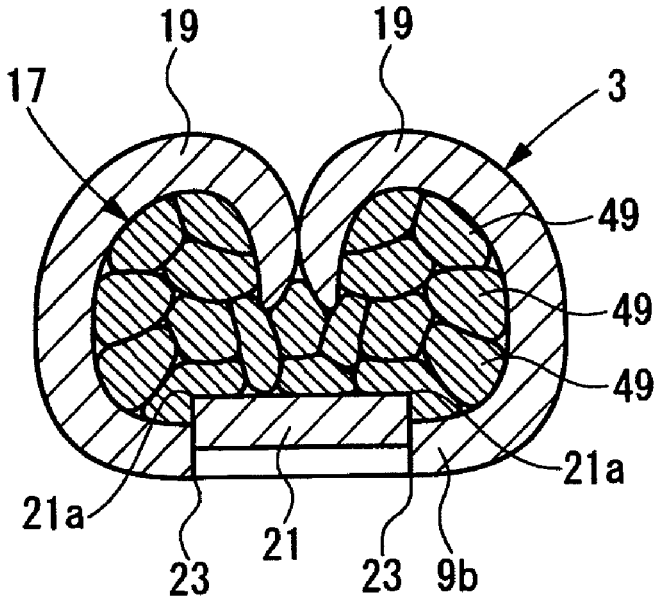
FIG. 3 is a cross-sectional view taken along the line B-B of FIG. 1, showing a conductor press-fastening portion press-fastened to a wire conductor.

FIG. 1 is a perspective view of the aluminum wire crimp terminal of the invention, FIG. 2 is a cross-sectional view taken along the line A-A of FIG. 1, FIG. 3 is a cross-sectional view taken along the line B-B of FIG. 1, showing a conductor press-fastening portion press-fastened to a wire conductor.

The aluminum wire crimp terminal 100 is formed by pressing a single metal sheet into a predetermined shape, and therefore has an integral or one-piece construction, and includes a sheath press-fastening portion 1, the conductor press-fastening portion 3 and an electrical contact portion 5 which are arranged in this order from its proximal end (right-hand end in FIG. 1). In this embodiment, although the electrical contact portion 5 is of the female type, it may be of any other suitable type such as a male-type electrical contact portion and a screw-fastening terminal portion having a screw passage hole.

Although the aluminum wire crimp terminal 100 can be formed of a sheet of electrically-conductive metal such as copper, copper alloy, aluminum and aluminum alloy, it is preferred that the crimp terminal 100 be formed of copper or copper alloy excellent in electrical conductivity and mechanical strength.

The sheath press-fastening portion 1 has a pair of press-fastening claws 11 and 11 extending respectively from opposite side edges of a rear end portion of a bottom plate portion 9 (on which the sheathed aluminum wire 7 (see FIGS. 4A to 4C) is adapted to be placed). With the use of a crimping apparatus 13 (see FIGS. 5 and 6), the pair of press-fastening claws 11 and 11 are press-fastened onto an insulative sheath 15 (see FIG. 6) of the sheathed aluminum wire 7 placed on the bottom plate portion 9, thereby fixing the sheathed aluminum wire 7.

The conductor press-fastening portion 3 includes a conductor support portion 9*b* (which is part of the bottom plate portion 9) for the placing of an exposed portion of the wire conductor 17 (see FIGS. 4A to 4C) thereon (which exposed portion is exposed by removing the insulative sheath 15 from one end portion of the sheathed aluminum wire 7), and a pair of press-fastening claws 19 and 19 extending respectively from opposite side edges of the conductor support portion 9*b*. With the use of the crimping apparatus 13, the pair of press-fastening claws 19 and 19 are press-fastened onto the wire conductor 17 placed on the conductor support portion 9, thereby fixing the sheathed aluminum wire 7.

The aluminum wire crimp terminal 100 further includes a raised portion (or protuberance) 21 formed on an inner surface of the conductor support portion 9*b*. For forming the raised portion 21, a pair of slits 23 and 23 extending parallel to an axis G (see FIGS. 4A to 4C) of the wire conductor 17 placed on the conductor support portion 9*b* are formed in the bottom plate portion 9, and then that portion of the bottom plate portion 9 lying between the pair of slits 23 and 23 is raised or stamped out of the remainder of the bottom plate portion 9 to form the raised portion 21. The stamped-out portion is raised to be partially separated from the bottom plate portion 9, and flat slanting surfaces can be formed on the stamped-out portion. The raised portion 21 is integrally connected at its opposite ends with the bottom plate portion 9. The raised portion 21 thus stamped out of the sheet has sharp edges 21*a*.

The raised portion 21 formed by raising the portion lying between the axial slits 23 and 23, and projects toward the wire conductor 17, and has a generally curved-shape (or may have an arc-shape) such that the raised portion 21 has slanting surfaces 25 and 27 extending in a direction along the axis of the wire conductor 17.

Auxiliary contact portions 29 are formed in a projecting manner on the slanting surfaces 25 and 27 of the raised portion 21. The auxiliary contact portions 29 project from the slanting surfaces 25 and 27, and therefore like an apex portion 31 of the raised portion 21, distal ends of the auxiliary contact portions 29 adhere to the wire conductor 17. "Adhesion" means a phenomenon in which solid bodies stick together at an area of contact therebetween by bonding forces exerted by atoms on their contact surfaces. Only with the raised portion 21, the apex portion 31 mainly adheres to the wire conductor 17 during the crimping operation. However, since the auxiliary contact portions 29 are provided, the apex portion 31 and the auxiliary contact portion 29 of the raised portion 21 adhere to the wire conductor 17 during the crimping operation.

The auxiliary contact portions 29 are formed on both of the two slanting surfaces 25 and 27 slanting respectively in the opposite directions from the apex portion 31 of the mountain-shaped raised portion 21. The area of adhesion is doubled as compared with the case where the auxiliary contact portions 29 are formed only on one of the slanting surfaces 25 and 27. And besides, the adhesion areas disposed respectively at the opposite sides of the apex portion 31 are equal to each other, and the wire conductor 17, when pressed against the raised portion 21, is elongated uniformly in the opposite directions from the apex portion 31, so that a stable adhesion performance can be obtained.

The plurality of auxiliary contact portions 29 are formed on each of the two slanting surfaces 25 and 27, and are arranged along the direction of slanting of the slanting surface 25, 27. Therefore, the auxiliary contact portions 29 on each of the slanting surfaces 25 and 27 are arranged in downward sequence from the apex portion 31. During the time when the raised portion 21 is generally flattened upon application of a pressing force to the apex portion 31, the auxiliary contact portions 29 are brought sequentially into contact with the wire conductor wire 17 from the upper side, and therefore the adhesion area is gradually increased.

In this embodiment, the auxiliary contact portions 29 on each slanting surface 25, 27 are formed as a stair-like portion (or terraced portion) 35 having flat surfaces 33 disposed parallel to the bottom plate portion 9. The flat surfaces 33 resembling steps of stairs are formed respectively on the auxiliary contact portions 29. Thus, an increased number of flat surfaces 33 having good adhesion properties are provided. When the crimping is effected, the wire conductor 17 is compressed at the conductor press-fastening portion 3 to be elongated in directions along the axis G (see FIGS. 4A to 4C). The auxiliary contact portions 29 are moved in directions (indicated by arrows a in FIGS. 4A to 4C) along the axis G by a pressing load applied for crimping the wire conductor 17, thereby elongating the wire conductor 17. At this time, the adhesion of the wire conductor 17 to the flat surfaces 33 of the stair-like portion 35 is promoted by upward and downward loads due to the crimping and the right and left movements due to the elongation. Namely, the wire conductor 17 elongated by the crimping is liable to adhere to the flat surfaces 33 of the stair-like portion 35. With this adhesion, the electrical connection performance becomes stable.

Next, the procedure of connecting the above aluminum wire crimp terminal to the aluminum wire, as well as actions of the conductor press-fastening portion, will be described.

Figure 4A:
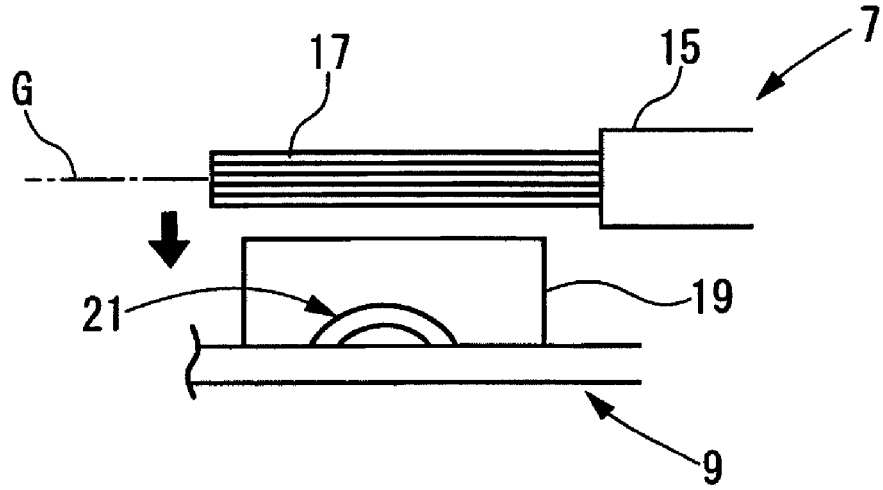
FIGS. 4A to 4C are views showing the procedure of the press-fastening operation and actions thereof.
Figure 4B:
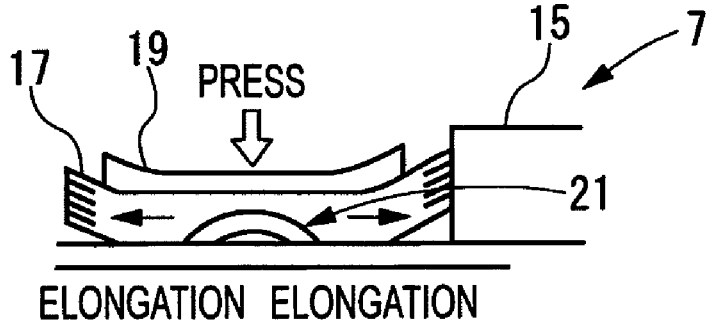
Figure 4C:
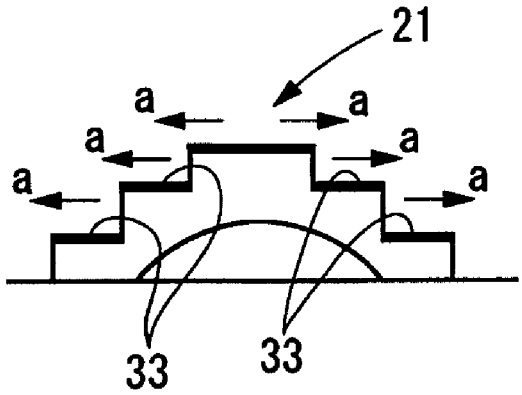
Figure 5:
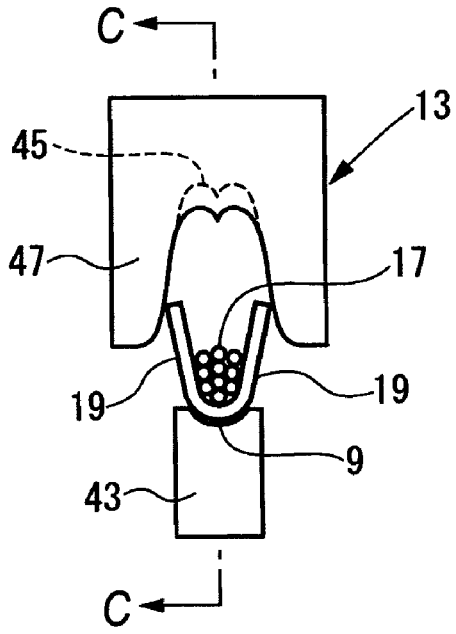
FIG. 5 is a front-elevational view of a crimping apparatus for press-fastening press-fastening claws.

FIGS. 4A, 4B and 4C are views showing the steps of the press-fastening operation and the actions of the conductor press-fastening portions during this operation. FIG. 5 is a front-elevational view of the crimping apparatus for press-fastening the press-fastening claws into a predetermined shape, and FIG. 6 is a cross-sectional view taken along the line C-C of FIG. 5.

Figure 6:
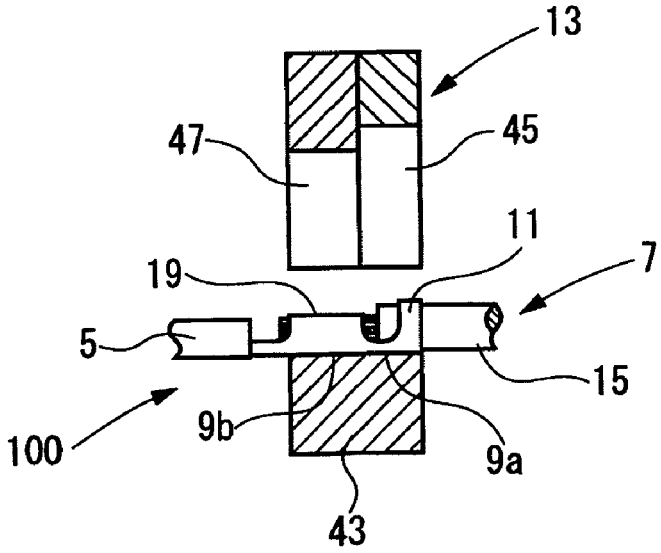
FIG. 6 is a cross-sectional view taken along the line C-C of FIG. 5.
Figure 7:
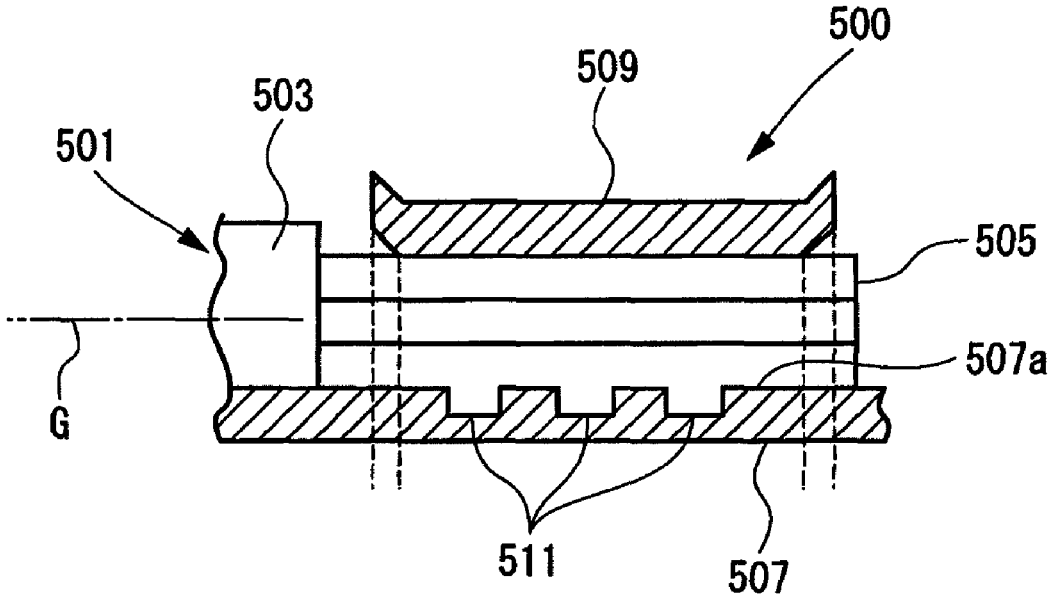
FIG. 7 is a cross-sectional view of an important portion of a conductor press-fastening portion of a conventional crimp terminal.
Figure 8:
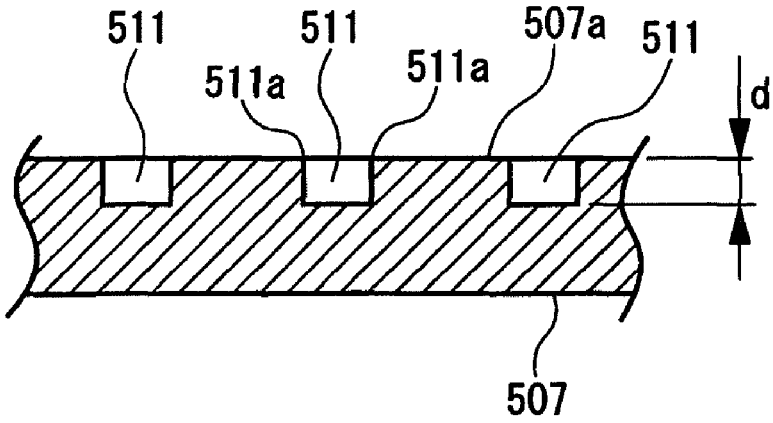
FIG. 8 is a cross-sectional view of a bottom plate portion having serrations.

As shown in FIGS. 5 and 6, the crimping apparatus 13 comprises an anvil 43 for supporting that portion of the bottom plate portion 9 having the sheath press-fastening portion 1 and the conductor press-fastening portion 3 formed thereon, and two crimpers 45 and 47 vertically-movably located above the anvil 43 so as to press-fasten the pair of press-fastening claws 11 and the pair of press-fastening claws 19, respectively.

As shown in FIG. 3, the pair of press-fastening claws 19 and 19 are press-fastened (or crimped) onto the wire conductor 17 such that the thus crimped press-fastening claws 19 and 19 are disposed substantially symmetrically with respect to a plane substantially perpendicular to the bottom plate portion 9 and containing the axis of the wire conductor 17. More specifically, the pair of press-fastening claws 19 and 19 are bent in such a manner that their distal end portions bite into the wire conductor 17, and therefore the press-fastening claws 19 and 19 thus press-fastened on the wire conductor 17 embrace part of wire elements 49 of the wire conductor 17.

During the time when the wire conductor 17 is compressed by the press-fastening claws 19 and 19, the wire conductor 17 is brought into contact with the sharp edges 21*a* of the raised portion 21. At this time, the edges 21*a* scrape oxide films from the surfaces of those wire elements 49 of the wire conductor 17 contacting the edges 21*a*, so that bare surfaces of these wire elements 49 made of aluminum or aluminum alloy are exposed. As a result, a good electrical connection between the wire conductor 17 and the aluminum wire crimp terminal 100 is secured.

The wire conductor 17 compressed by the pair of press-fastening claws 19 and 19 press-fastened thereto presses the raised portion 21 toward the bottom plate portion 9. The raised portion 21 is elastically deformed to reduce a gap between it and the bottom plate portion 9, and causes an elastic reaction force to act on the wire conductor 17. As a result, a contact resistance between the wire conductor 17 and the aluminum wire crimp terminal 100 can be reduced without increasing a compression rate of the wire conductor 17, and with the compression rate of the wire conductor 17 which is generally equal to that of a copper wire, a satisfactory crimping strength of the aluminum wire crimp terminal 100 can be obtained. Furthermore, even when springing-back occurs in the press-fastening claws 19 and 19, the raised portion 21 can be restored to prevent a clearance from developing between each press-fastening claw 19 and the wire conductor 17, thus maintaining the contact resistance between the wire conductor 17 and the aluminum wire crimp terminal 100 and the crimping strength of the aluminum wire crimp terminal 100.

In the aluminum wire crimp terminal 100, the area of adhesion to the wire conductor 17 is increased by an amount corresponding to the areas of the flat surfaces 33 of the auxiliary contact portions 29. If the raised portion 21 is formed merely into the mountain-shape (that is, does not have any auxiliary portion 29), the raised portion 21 obliquely receives the pressing force except at its apex portion when the wire conductor 17 of the sheathed aluminum wire 7 is pressed against the raised portion 21 upon press-fastening of the press-fastening claws 19 and 19, since the wire conductor 17 extends in the axial direction. In this case, the adhesion will not occur sufficiently. On the other hand, in this embodiment, the auxiliary contact portions 29 forming the stair-like portion 35 having the flat surfaces 33 are formed on the slanting surfaces 25 and 27, and with this construction the flat surfaces 33 of the auxiliary contact portions 29 adhere to the wire conductor 17, so that the increased adhesion area is secured.

In the manufacture of the aluminum wire crimp terminal 100, part of the bottom plate portion 9 is stamped out into a generally mountain-shape to form the raised portion 21. A die having a stair-like shape is pressed against this raised portion 21 to form the auxiliary contact portions 29. Thus, first, the raised portion 21 of the generally mountain-shape is formed by stamping with a large pressing force, and thereafter the auxiliary contact portions 29 are formed on the slanting surfaces 25 and 27 with a smaller pressing force, and by doing so, the deformation of the initially-formed mountain shape is kept to a minimum.

In the manufacture of the aluminum wire crimp terminal 100, the stamped-out portion and the auxiliary contact portions 29 can be formed simultaneously, using a mountain-shaped stair-like die (not shown). By using the mountain-shaped stair-like die of an integral construction, the raised portion 21 having the auxiliary contact portions 29 formed on the slanting surfaces 25 and 27 can be formed by one pressing step, and the productivity of the aluminum wire crimp terminals 100 can be enhanced.

Therefore, in the above aluminum wire crimp terminal 100, the mountain-shaped raised portion 21 is formed at the bottom plate portion 9, and the auxiliary contact portions 29 are formed in a projecting manner on the slanting surfaces 25 and 27 of this raised portion 21, and the auxiliary contact portions 29 are moved or displaced in the directions (indicated by arrows a in FIG. 4C) along the axis by the pressing load applied for crimping the wire conductor 17, thereby elongating the wire conductor 17. Therefore, as compared with the case where the raised portion 21 is formed merely into a mountain-shape having only one apex portion 31 (that is, does not have any auxiliary portion 29), the increased area of adhesion to the wire conductor 17 is obtained, and thus the adhesion area can be increased while obtaining a high elastic reaction force by the raised portion 21. As a result, both the electrical connection performance and the mechanical connection performance can be enhanced.

Furthermore, in the method of producing the aluminum wire crimp terminal 100, part of the bottom plate portion is stamped out into the mountain-shape to form the raised portion 21, and the die having the stair-like shape is pressed against this raised portion 21 to form the auxiliary contact portions 29. Therefore, after the relevant portion of the bottom plate portion 9 is stamped out with a large pressing force to form the raised portion 21, the auxiliary contact portions 29 can be formed in a projecting manner on the slanting surfaces 25 and 27 of this raised portion 21 with a smaller pressing force without deforming the mountain-shape of the raised portion 21.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2008-274635 filed on Oct. 24, 2009, the contents of which are incorporated herein for reference.

What is claimed is:

1. A crimp terminal, comprising:

a bottom plate portion for mounting a wire conductor of a wire thereon;

a pair of press-fastening portions extended respectively from opposite side edges of the bottom plate portion to press-fasten the wire conductor;

a raised portion provided on the bottom plate portion, the raised portion having a curved shape, projecting toward the wire conductor, so as to define a pair of slanting surfaces respectively extending from the bottom plate portion and an apex portion disposed between the slanting surfaces; and an auxiliary contact portion protrudingly formed on at least one of the slanting surfaces, wherein the auxiliary contact portion is moved in a direction along the axis of the wire conductor by a pressing load applied for crimping the wire conductor so that the wire conductor is elongated, and wherein the apex portion is disposed at different location than the auxiliary contact portion.

2. The crimp terminal according to claim 1, wherein the auxiliary contact portion and other auxiliary contact portions are formed on both of the slanting surfaces respectively, the slanting surfaces slanting in opposite directions from the apex portion of the raised portion.

3. The crimp terminal according to claim 1, wherein the auxiliary contact portion and other auxiliary contact portions are formed on the slanting surfaces so as to be arranged in a slanting direction of the slanting surfaces.

4. The crimp terminal according to claim 1, wherein the auxiliary contact portion is a stair-like portion having a flat surface substantially parallel to the bottom plate portion.

5. The crimp terminal according to claim 1, wherein the raised portion is arranged between a pair of slits formed in the bottom plate portion, the pair of slits extending along the axis of the wire conductor; and wherein the raised portion is integrally formed on the bottom plate portion.

6. A method of producing a crimp terminal including a bottom plate portion for mounting a wire conductor of a wire thereon, a pair of press-fastening portions extended respectively from opposite side edges of the bottom plate portion to press-fasten the wire conductor, a raised portion provided on the bottom plate portion, and that has slanting surfaces slanting along an axis of the wire conductor mounted on the bottom plate portion to form a curved shape projecting toward the wire conductor, and an auxiliary contact portion protrudingly formed on the slanting surface, the method comprising:

stamping a part of the bottom plate portion into a curved shape to form the raised portion; and pressing a die of a stair-like shape against the raised portion to form the auxiliary contact portion.

7. The method according to claim 6, wherein the raised portion and the auxiliary contact portion are formed simultaneously by a curved-shape stair-like die.

* * * * *